US006241154B1

(12) United States Patent
Weng

(10) Patent No.: US 6,241,154 B1
(45) Date of Patent: Jun. 5, 2001

(54) AIR CONDITIONING DEVICE

(75) Inventor: Kuo-Liang Weng, Taichung (TW)

(73) Assignee: Yiue Feng Enterprise Co., Ltd., Taichung Hsien (TW)

( * ) Notice: Subject to any disclaimer, the term of this patent is extended or adjusted under 35 U.S.C. 154(b) by 0 days.

(21) Appl. No.: 09/198,282

(22) Filed: Nov. 23, 1998

(51) Int. Cl.[7] ..... G05D 23/00; F24F 7/00
(52) U.S. Cl. ..... 236/13; 236/49.3; 454/236
(58) Field of Search ..... 165/103; 236/13, 236/49.3; 454/233, 266, 269, 236

(56) References Cited

U.S. PATENT DOCUMENTS 2,247,987 * 7/1941 Carson ..... 165/103
2,828,110 * 3/1958 Baker et al. ..... 165/103 X
5,340,021 * 8/1994 Kajino et al. ..... 236/49.3

* cited by examiner

*Primary Examiner*—William Wayner
(74) *Attorney, Agent, or Firm*—Alan D. Kamrath; Rider, Bennett, Egan & Arundel, LLP

(57) ABSTRACT

An air conditioning device has a controller, a fan motor, a by-path strangler, and a heat exchange pipe. The fan motor is disposed in front of the heat exchange pipe. The by-path strangler is disposed between the fan motor and the heat exchange pipe. The controller controls the by-path strangler. The controller has a central processing unit, an output control unit, a detect unit, and a sensor. The sensor senses an environmental detect value to the detect unit. The detect unit outputs the environmental detect value to the central processing unit. The central processing unit outputs a signal to the output control unit. The output control unit has a plurality of output junctions connected to a loading unit. The loading unit has a drive motor and two electric valves.

6 Claims, 7 Drawing Sheets

AIR CONDITIONING DEVICE

BACKGROUND OF THE INVENTION

The invention relates to an air conditioning device. More particularly, the invention relates to an air conditioning device which has a by-path damper.

Referring to FIGS. 1 to 3, a conventional air conditioning device has a fan motor 71, a heat exchanger 72, and a control electric circuit 73. The variation speeds of the conventional air conditioning device have three steps only, such as a full speed, a middle speed, and a low speed. However, the three step adjustment of the conventional air conditioning device will cause a large fluctuation of room temperatures.

SUMMARY OF THE INVENTION

An object of the invention is to provide an air conditioning device which can save energy efficiently.

Another object of the invention is to provide an air conditioning device which has an efficient by-pass damper to adjust the amount of air condition auto-matically.

Accordingly, an air conditioning device comprises a controller, a fan motor, a by-pass damper, and a heat exchanger. The fan motor is disposed in front of the heat exchanger. The by-pass damper is disposed between the fan motor and the heat exchanger. The controller controls the by-pass damper. The controller has a central processing unit, an output control unit, a detect unit, and a sensor. The sensor senses an environmental detect value to the detect unit. The detect unit outputs the environmental detect value to the central processing unit. The central processing unit outputs a signal to the output control unit. The output control unit has a plurality of output junctions connected to a loading unit.

DETAILED DESCRIPTION OF THE INVENTION

Figure 1:
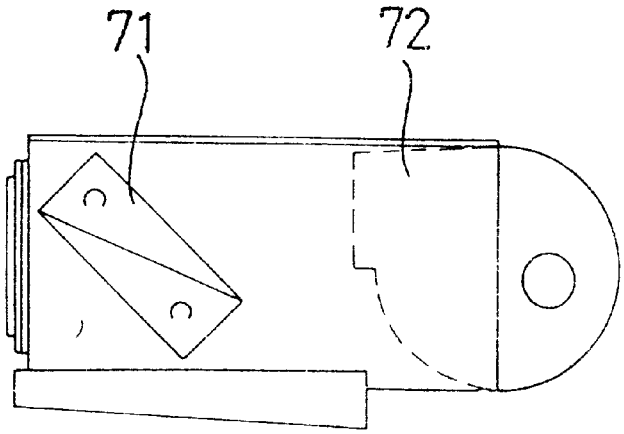
FIG. 1 is a schematic view of a conventional air conditioning device of the prior art.
Figure 2:
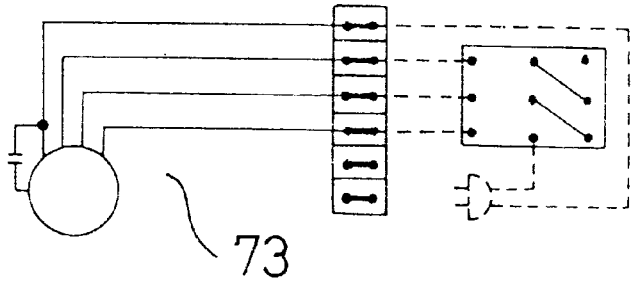
FIG. 2 is a schematic diagram of a control electric circuit of the prior art.
Figure 3:
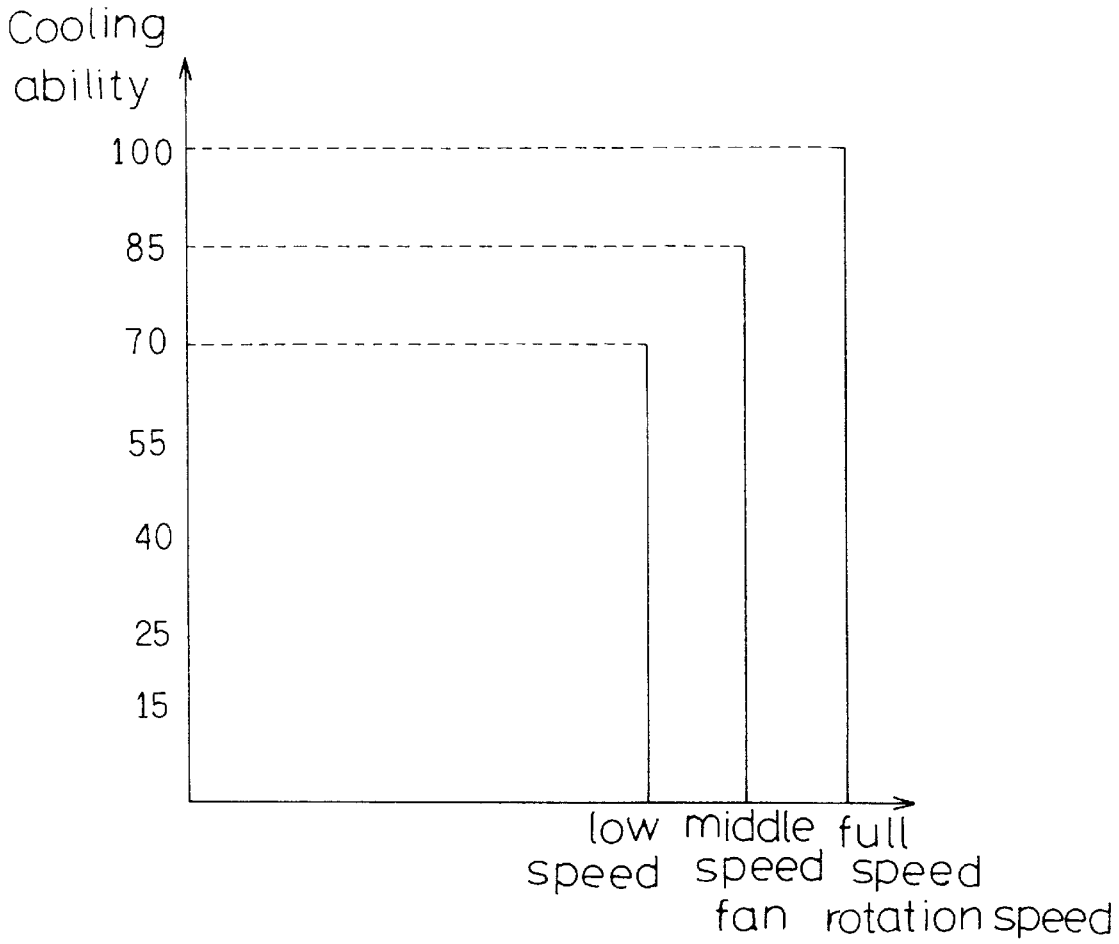
FIG. 3 is a diagram showing a cooling ability versus fan rotation speed of the prior art.
Figure 4:
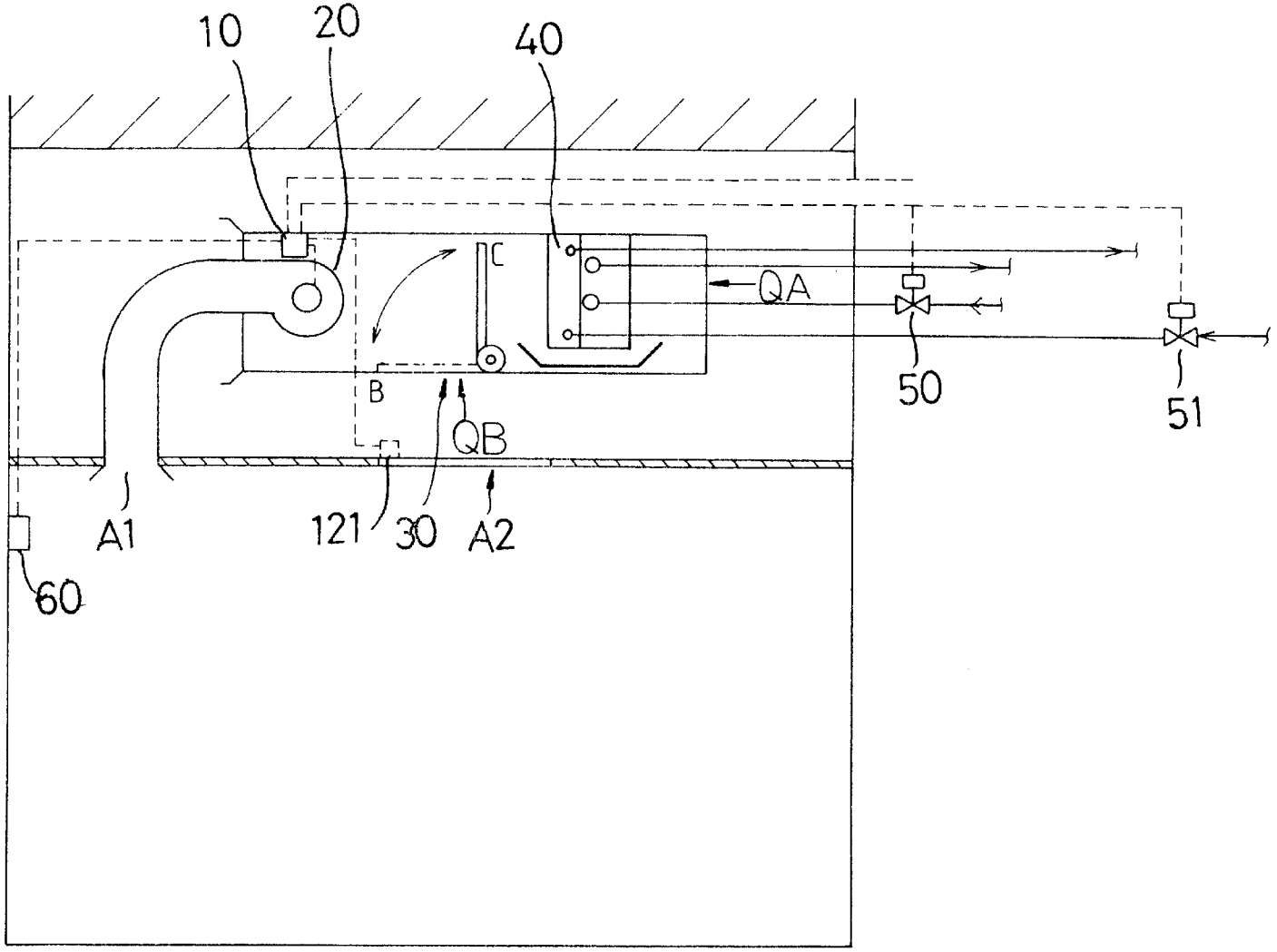
FIG. 4 is a schematic view of an air conditioning device of a preferred embodiment in accordance with the invention.
Figure 5:
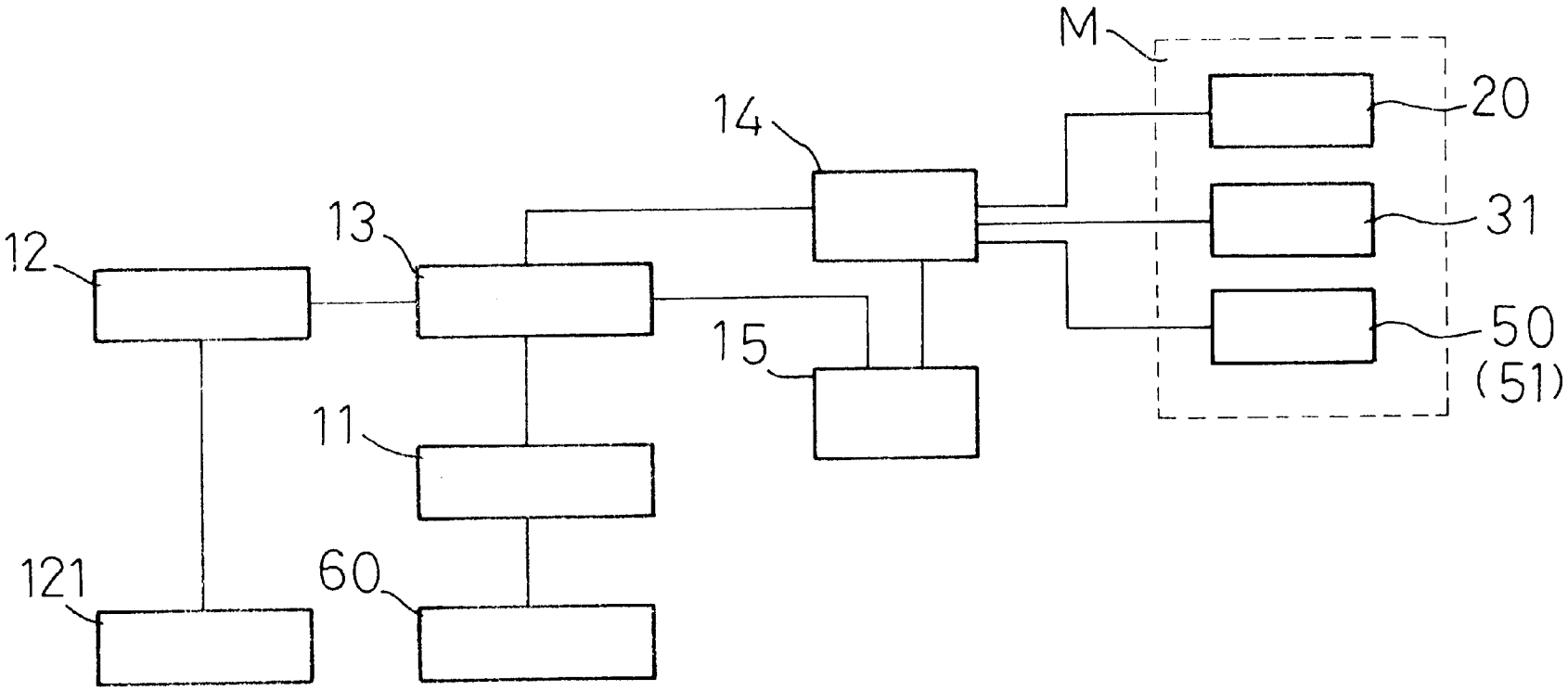
FIG. 5 is a block diagram of an air conditioning device of a preferred embodiment in accordance with the invention.
Figure 6:
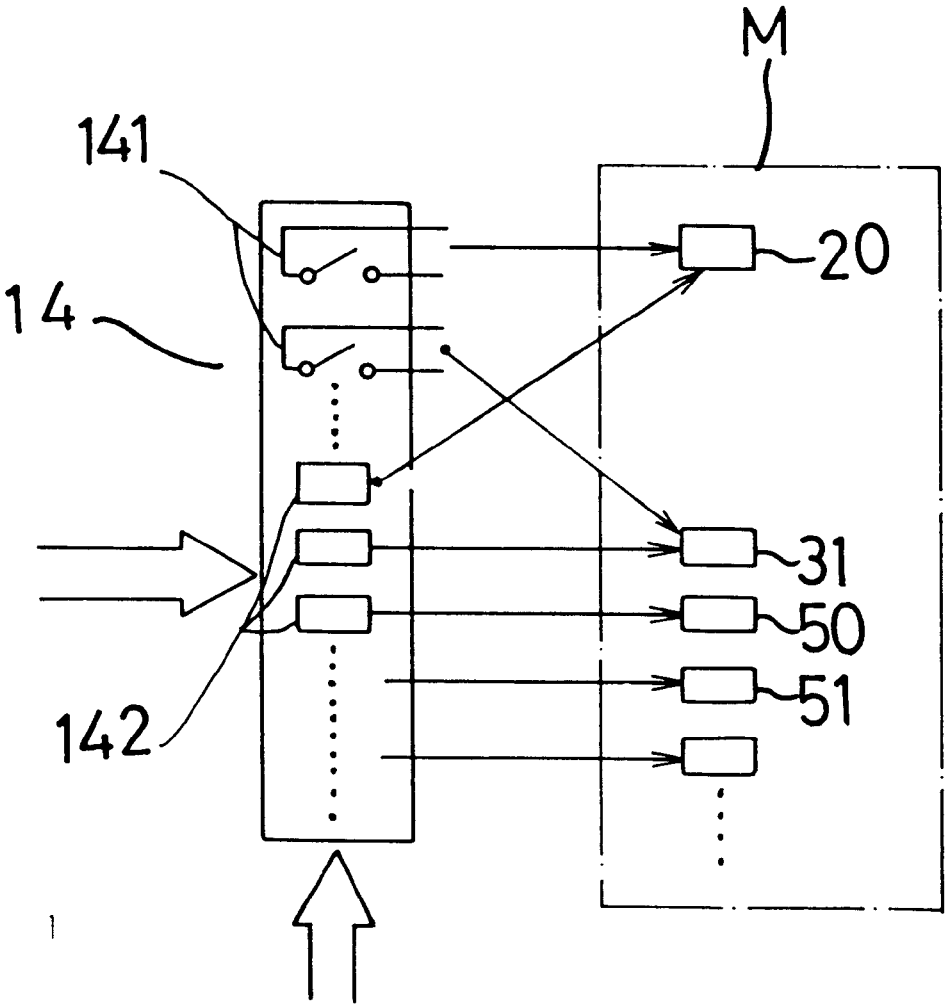
FIG. 6 is a schematic diagram of a control electric circuit of a preferred embodiment in accordance with the invention.

Referring to FIGS. 4 to 8, an air conditioning device comprises a controller 10, a fan motor 20, a by-pass damper 30, and a heat exchanger 40. The fan motor 20 is disposed in front of the heat exchanger 40. The by-pass damper 30 is disposed between the fan motor 20 and the heat exchanger 40. The controller 10 controls the by-pass damper 30. A vent outter A1 communicates with the fan motor 20. An operation set unit 60 is disposed in the air conditioning device. A first electric valve 50 and a second electric valve 51 are disposed in the air conditioning device. QA represents an air flow via the heat exchanger 40. QB represents an air flow via the by-pass damper 30. A2 represents an air conditioning area.

The controller 10 has a central processing unit 13, an output control unit 14, a detect unit 12, a sensor 121, a function set unit 11, the operation set unit 60, an electric source supply unit 15, and a loading unit M. The sensor 121 senses an environmental detect value (TA) to the detect unit 12. The detect unit 12 outputs the environmental detect value (TA) to the central processing unit 13. The central processing unit 13 outputs a signal to the output control unit 14. The output control unit 14 has a plurality of output electric source devices 142, and a plurality of output junctions 141 connected to the loading unit M. The sensor 121 is connected to the detect unit 12. The detect unit 12 is connected to the central processing unit 13. The central processing unit 13 is connected to the output control unit 14. The operation set unit 60 is connected to the function set unit 11. The function set unit 11 is connected to the central processing unit 13. The electric source supply unit 15 is connected to the central processing unit 13 and the output control unit 14. The output control unit 14 is connected to the loading unit M. The loading unit M has the fan motor 20, a drive motor 31, and at least an electric valve such as the first electric valve 50 and the second electric valve 51. The loading unit M further has a main frame and a central monitor system (not shown in the figures).

The operation set unit 60 outputs a set value (TS) such as a set temperature value into the function set unit 11. The function set unit 11 sends the signal of the set value (TS) into the central processing unit 13. The electric source supply unit 15 supplies electricity to the central processing unit 13 and the output control unit 14. The central processing unit 13 sends an instruction to the output control unit 14. The output control unit 14 controls the loading unit M. It is an option to connect an outer system to the function set unit 11. The outer system can be a computer or a central monitor system.

Figure 7:
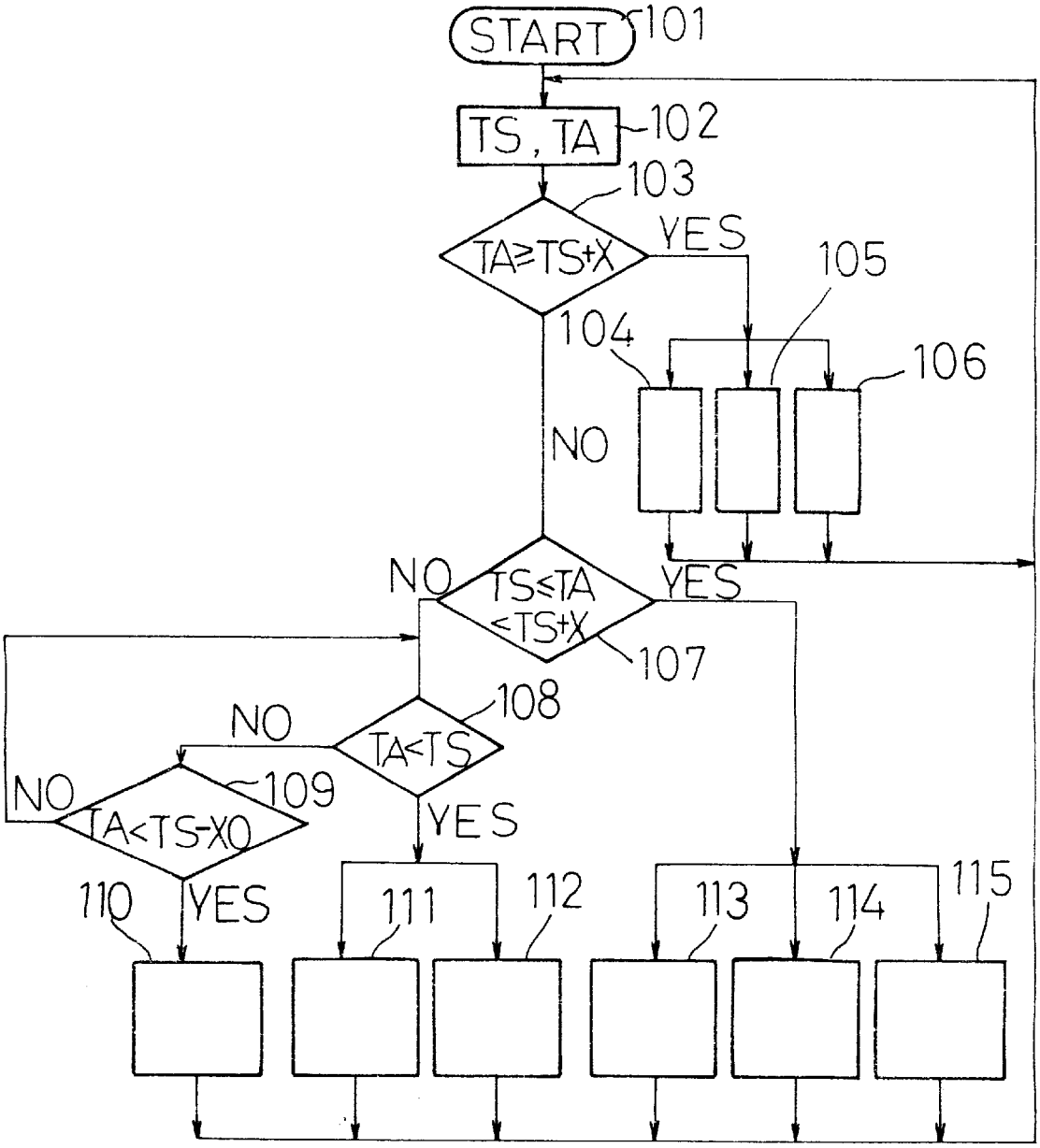
FIG. 7 is a flow diagram showing a simulation control of providing cooling air.

Referring to FIG. 7, a simulation control of providing cooling air is illustrated.

Step 101: Start an operation.

Step 102: Compare TS and TA.

Step 103: If TA≧TS+X, then go to one of Step 104, Step 105, and Step 106. If not, then go to Step 107.

Step 104: Close the by-pass damper 30 completely.

Step 105: Turn on the output junctions 141.

Step 106: Rotate the fan motor 20 in a full speed.

Step 107: If TS≦TA<TS+X, then go to one of Step 113, Step 114, and Step 115. If not, then go to Step 108.

Step 108: If TA<TS, then go to one of Step 111 and Step 112. If not, then go to Step 109.

Step 109: If TA<TS−XO, then go to Step 110. If not, then go to Step 108. XO represents the set difference value.

Step 110: Turn off the output junctions 141.

Step 111: Rotate the fan motor 20 in a lowest speed.

Step 112: Open the by-pass damper 30 completely.

Step 113: Open the by-pass damper 30 in inverse proportion to TA.

Step 114: Turn on the output junctions 141.

Step 115: Rotate the fan motor 20 in a speed proportional to TA.

Therefore, the fan motor 20 can rotate steplessly. The air conditioning device can save energy efficiently.

Figure 8:
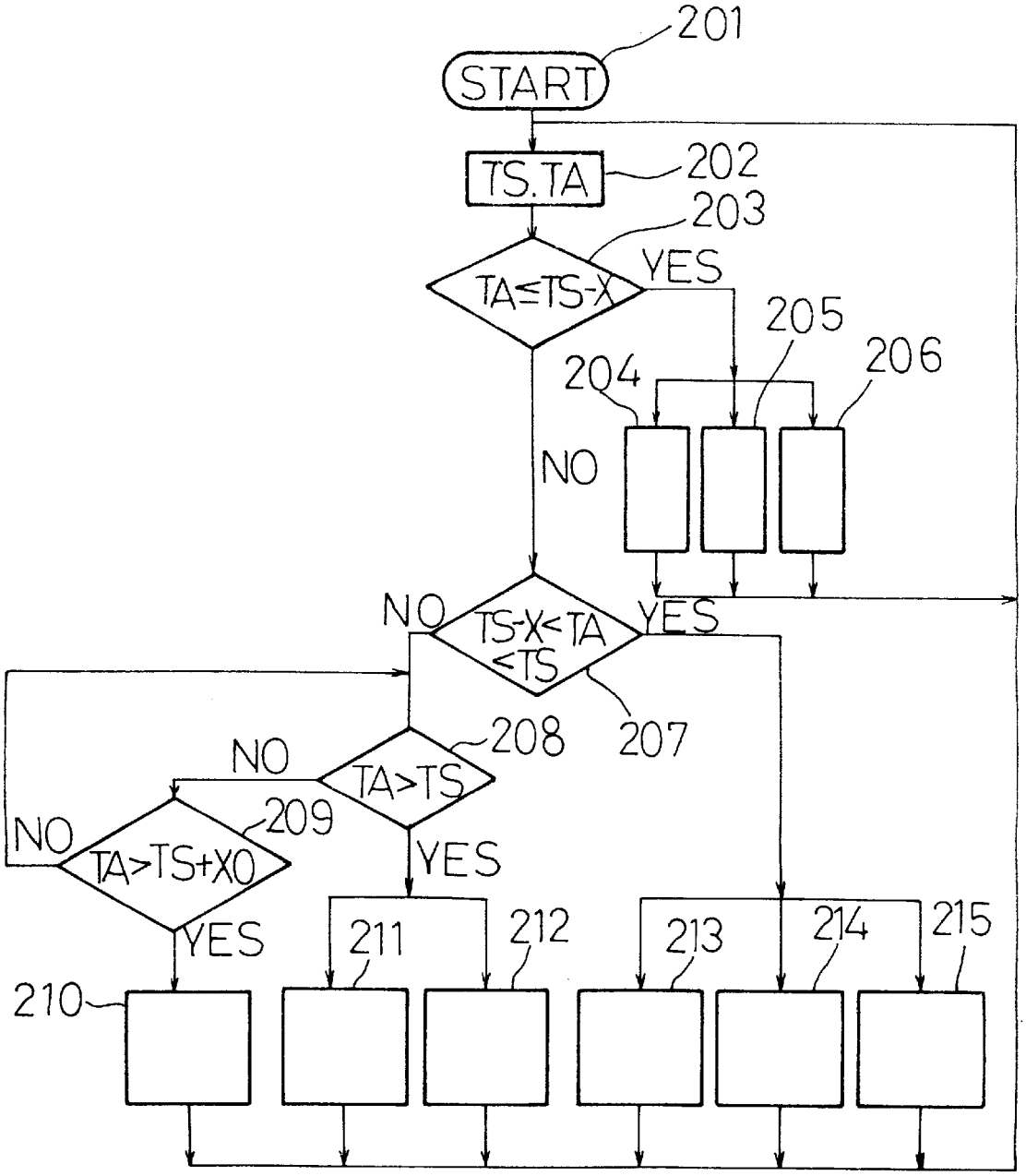
FIG. 8 is a flow diagram showing a simulation control of providing warm air.

Referring to FIG. 8, a simulation control of providing warm air is illustrated.

Step 201: Start an operation.

Step 202: Compare TS and TA.

Step 203: If TA≦TS−X, then go to one of Step 204, Step 205, and Step 206. If not, then go to Step 207.

Step 204: Close the by-pass damper 30 completely.

Step 205: Turn on the output junctions 141.

Step 206: Rotate the fan motor 20 in a full speed.

Step 207: If TS−X<TA<TS, then go to one of Step 213, Step 214, and Step 215. If not, then go to Step 208.

Step 208: If TA>TS, then go to one of Step 211 and Step 212. If not, then go to Step 209.

Step 209: If TA>TS+XO, then go to Step 210. If not, then go to Step 208. XO represents the set difference value.

Step 210: Turn off the output junctions 141.

Step 211: Rotate the fan motor 20 in a lowest speed.

Step 212: Open the by-pass damper 30 completely.

Step 213: Open the by-pass damper 30 in inverse proportion to TA.

Step 214: Turn on the output junctions 141.

Step 215: Rotate the fan motor 20 in a speed proportional to TA.

Therefore, the fan motor 20 can rotate steplessly. The air conditioning device can save energy efficiently.

The invention is not limited to the above embodiment but various modification thereof may be made. Further, various changes in form and detail may be made without departing from the scope of the invention.

I claim:

1. An air conditioning device for a room comprising, in combination:

a controller, a fan motor, a by-pass damper, and a heat exchanger, the fan motor disposed in front of the heat exchanger, the by-pass damper disposed between the fan motor and the heat exchanger and selectively providing communication to the fan motor from the room and from the heat exchanger, the controller having a central processing unit, an output control unit, a detect unit, and a sensor, the sensor sensing an environmental detect value to the detect unit, the detect unit outputting the environmental detect value to the central processing unit, the central processing unit outputting a signal to the output control unit, and the output control unit having a plurality of output junctions connected to a loading unit having the by-pass damper whereby the controller controls the by-pass damper.

2. An air conditioning device as claimed in claim 1, wherein the loading unit has a drive motor moving the by-pass damper and at least an electric valve controlling the heat exchanger.

3. An air circulating device as claimed in claim 2, wherein the loading unit has the fan motor.

4. An air circulating device as claimed in claim 1, further comprising, in combination: an operation set unit outputting a set temperature value to the central processing unit.

5. An air circulating device as claimed in claim 1, further comprising, in combination: an electric source supply unit connected to the central processing unit and the output control unit.

6. An air circulating device as claimed in claim 1, wherein the loading unit has the fan motor.

* * * * *